US012065904B2

(12) United States Patent
Macdonald et al.

(10) Patent No.: US 12,065,904 B2
(45) Date of Patent: Aug. 20, 2024

(54) FULLY INTEGRATED FLOW CONTROL MODULE

(71) Applicant: Baker Hughes Energy Technology UK Limited, Bristol (GB)

(72) Inventors: Scott Macdonald, Fife (GB); Stephen Mackin, Stonehaven (GB); Emma Stewart, Newtonhill (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/203,454

(22) Filed: May 30, 2023

(65) Prior Publication Data

US 2023/0323744 A1 Oct. 12, 2023

Related U.S. Application Data

(63) Continuation of application No. 18/117,678, filed on Mar. 6, 2023.

(Continued)

(51) Int. Cl.
*E21B 34/02* (2006.01)
*E21B 21/08* (2006.01)

(Continued)

(52) U.S. Cl.
CPC ..... *E21B 34/025* (2020.05); *E21B 21/08* (2013.01); *E21B 21/10* (2013.01); *E21B 47/06* (2013.01)

(58) Field of Classification Search
CPC ..... E21B 43/121; E21B 43/162; E21B 47/06; E21B 47/138; E21B 2200/20; E21B 21/08; E21B 21/10; E21B 21/106; E21B 34/025
See application file for complete search history.

(56) References Cited

U.S. PATENT DOCUMENTS 6,460,621 B2 10/2002 Fenton
8,997,876 B2 4/2015 McHugh (Continued)

FOREIGN PATENT DOCUMENTS

WO 2014/070737 5/2014
WO 2017/209728 12/2017

(Continued)

OTHER PUBLICATIONS

Lars Martin Hosaas, "Conditional monitoring and operational management of a subsea production system," Jun. 15, 2015, University of Stavanger, 4 pages.

(Continued)

*Primary Examiner* — Brad Harcourt
(74) *Attorney, Agent, or Firm* — Hogan Lovells US LLP

(57) ABSTRACT

A system and method for a fully-integrated flow control module (FI-FCM) in a hydrocarbon reservoir is disclosed. The FI-FCM is a unibody structure or a single-piece machined body having a flow meter integrated to the unibody structure. A choke is to be associated within a provision of the FI-FCM that also has an entry flow path for reservoir fluid and an exit flow path for the reservoir fluid. The entry flow path and the exit flow path inside the unibody structure or the single-piece machined body. Fluid communication is enabled between the flow meter, which is upstream relative to the choke, and an entry flow path. The choke is to control flow between the entry flow path and the exit flow path.

20 Claims, 6 Drawing Sheets

Related U.S. Application Data

(60) Provisional application No. 63/322,522, filed on Mar. 22, 2022, provisional application No. 63/317,927, filed on Mar. 8, 2022.

(51) Int. Cl.
*E21B 21/10* (2006.01)
*E21B 47/06* (2012.01)

(56) References Cited

U.S. PATENT DOCUMENTS

| | | | |
|---|---|---|---|
| 9,169,709 | B2 | 10/2015 | Vincent |
| 9,365,271 | B2 | 6/2016 | Minnock |
| 9,702,215 | B1 | 7/2017 | Murphy |
| 10,184,310 | B2 | 1/2019 | McHugh |
| 10,533,395 | B2 | 1/2020 | Rustad |
| 10,808,483 | B2 | 10/2020 | Hosie |
| 10,947,803 | B2 | 3/2021 | Riley |
| 10,954,746 | B2 | 3/2021 | Murphy |
| 11,713,987 | B2 | 8/2023 | Berntsen |
| 2010/0132800 | A1* | 6/2010 | Jamaluddin ..... E21B 43/12 137/560 |
| 2014/0116716 | A1* | 5/2014 | Vincent ..... E21B 43/01 166/351 |
| 2017/0342792 | A1 | 11/2017 | McHugh |
| 2021/0230966 | A1* | 7/2021 | Dietrich ..... F16K 5/0207 |
| 2022/0403709 | A1* | 12/2022 | Clark ..... E21B 21/08 |

FOREIGN PATENT DOCUMENTS

| | | |
|---|---|---|
| WO | 2018/164657 | 9/2018 |
| WO | 2021/054957 | 3/2021 |
| WO | 2023/277697 | 1/2023 |

OTHER PUBLICATIONS

International Search Report and Written Opinion mailed Jun. 16, 2023 in corresponding PCT Application No. PCT/EP2023/025108.
Non-Final Office Action mailed Dec. 26, 2023 in U.S. Appl. No. 18/117,678.

* cited by examiner

FULLY INTEGRATED FLOW CONTROL MODULE

CROSS-REFERENCES TO RELATED APPLICATIONS

This application is a continuation of U.S. patent application Ser. No. 18/117,678, titled FULLY INTEGRATED FLOW CONTROL MODULE, filed Mar. 6, 2023, which is related to and claims the benefit of priority from U.S. Provisional Application No. 63/317,927, titled FULLY INTEGRATED FLOW CONTROL MODULE, filed Mar. 8, 2022, and U.S. Provisional Application No. 63/322,522, titled FULLY INTEGRATED FLOW CONTROL MODULE, filed Mar. 22, 2022, the entire disclosures of all of which are incorporated by reference herein for all intents and purposes.

BACKGROUND

1. Field of Invention

This invention relates in general to equipment used in onshore or offshore oil and gas production, and in particular, to a flow control modules in hydrocarbon reservoirs.

2. Description of the Prior Art

Onshore and offshore formations serve as hydrocarbon reservoirs. A system associated with such formations may require flow control modules (FCMs). An FCM can direct and manage flow of fluids therethrough. Industry specialist equipment such as chokes, sensors, and single-phase or multi-phase flowmeters may be used to measure and obtain data regarding reservoir fluid extracted from a well. Such a system may utilize an extensive and complicated arrangement of flow spools and machined blocks to package such industry specialist equipment therein, which may result in multiple connections that may be subject to potential leak paths. Such arrangements may also require a large footprint which may correlate to large amounts of capital expenditure.

SUMMARY

In at least one embodiment, a system for a fully-integrated flow control module (FI-FCM) in a hydrocarbon reservoir is disclosed. The system includes a unibody structure or a single-piece machined body forming the FI-FCM and may include a choke to be associated within a provision of the FI-FCM. The unibody structure or the single-piece machined body includes an entry flow path for reservoir fluid inside the FI-FCM and an exit flow path for the reservoir fluid inside the FI-FCM. A flow meter may be integrated in the unibody structure and may be in fluid communication with the entry flow path so that the flow meter is upstream relative to the choke. The choke may be used to control flow between the entry flow path and the exit flow path.

A method for a fully-integrated flow control module (FI-FCM) in a hydrocarbon reservoir is also disclosed, where such a method may be a method of operation of an FI-FCM. The method includes providing the FI-FCM as a unibody structure or a single-piece machined body that includes a flow meter integrated in the unibody structure or the single-piece machined body. The method includes associating a choke within a provision of the FI-FCM and enabling the flow meter to be in fluid communication with an entry flow path of a reservoir fluid. The flow meter, during formation of the unibody structure, is located upstream relative to the choke. The method includes controlling flow of the reservoir fluid between the entry flow path and an exit flow path using the choke.

A method for a fully-integrated flow control module (FI-FCM) in a hydrocarbon reservoir is also disclosed, where such a method may be a method of manufacture or provision versus a method of operation noted elsewhere herein. The method of manufacture or provision includes machining the FI-FCM as a unibody structure or a single-piece machined body that includes a flow meter integrated in the unibody structure or the single-piece machined body. The method includes enabling a provision within the FI-FCM for associating a choke within the provision. The method includes enabling the flow meter to be located upstream relative to the choke and to be located between an entry flow path and an exit flow path. The method includes enabling the choke to be used to control flow of a reservoir fluid between the entry flow path and an exit flow path.

BRIEF DESCRIPTION OF THE DRAWINGS

Various embodiments in accordance with the present disclosure will be described with reference to the drawings, in which.

DETAILED DESCRIPTION

Figure 1:
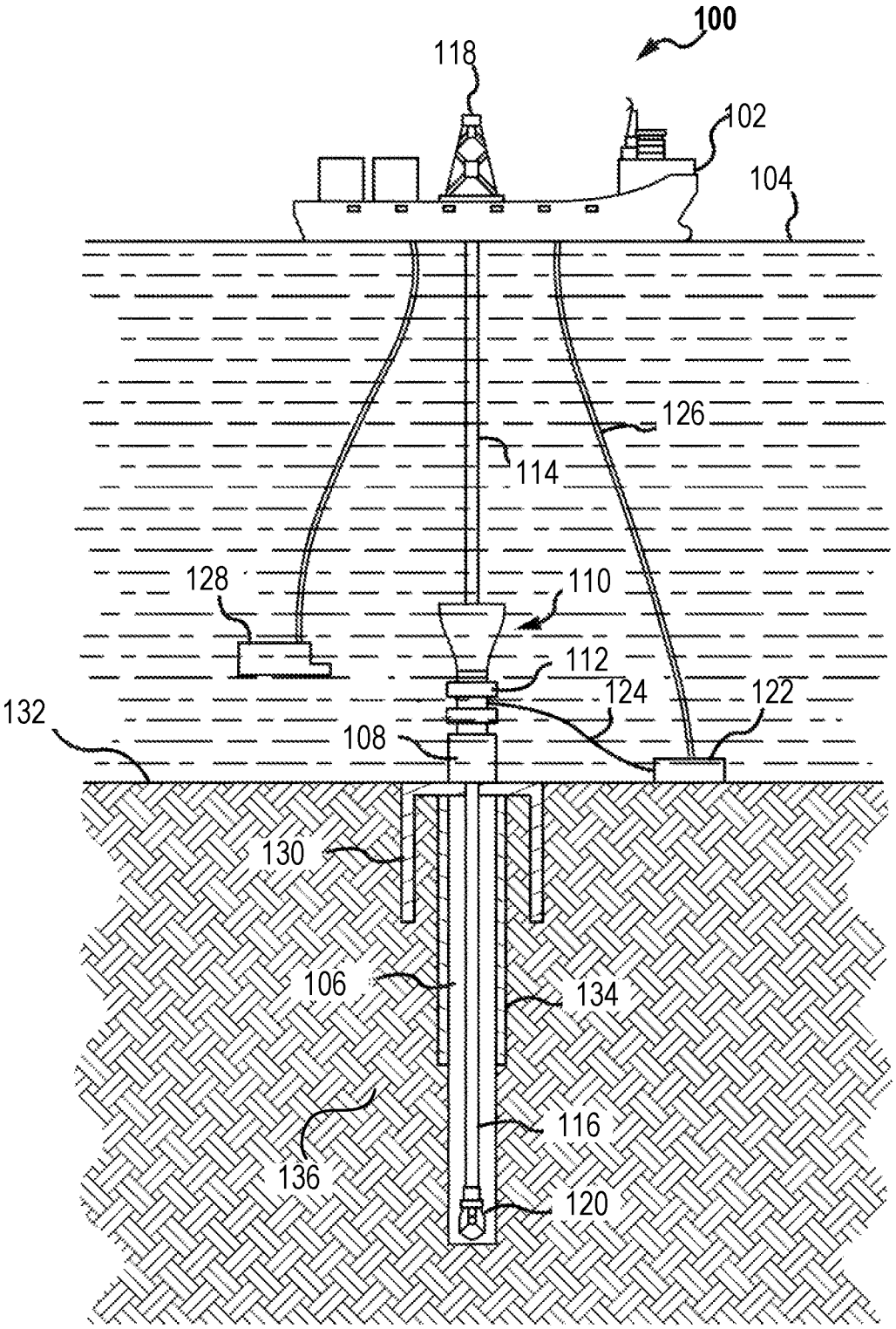
FIG. 1 illustrates an example environment subject to improvements of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described. Various other functions can be implemented within the various embodiments as well as discussed and suggested elsewhere herein. In at least an aspect, the present disclosure is to a system and a method for a fully-integrated flow control module (FI-FCM) that is a unibody structure having a flow meter integrated to the unibody structure.

In at least one embodiment, a system herein can address components of a flow control module (FCM) that may be subject to different lines and that then need cooperation to perform efficiently. Therefore, a system herein provides a compact single-piece machined body, also referred to herein a unibody or full-integrated structure, with provisions for necessary equipment of an FCM. In at least one embodiment, such a system provides an advantage by at least reducing the footprint, part count, and complexity of a flow control module. In at least one embodiment, the single-piece machined body may not include joints between a section having a flow meter and a section having a choke. In at least one embodiment, therefore, machining may be performed by additive manufacturing or computer numerical control (CNC) so that the single-piece machined body is a single solid piece of metal to accommodate a flow meter and a choke.

In at least one embodiment, a fully-integrated flow control module (FI-FCM) enables flow control for reservoir fluid from a production assembly connected to a well. The FI-FCM may be a single-piece machined body or a unibody structure with a flow meter that is integrated into the unibody structure to be in fluid communication between an entry flow path. The FI-FCM is located upstream relative to a choke. The choke may be associated within the unibody structure in a provision provided in the unibody structure. An entry flow path for the reservoir fluid and an exit flow path for the reservoir fluid are also enabled inside the unibody structure. The choke may be in fluid communication between the entry flow path and the exit flow path and the choke may be adapted to control flow between these flow paths for reservoir fluid.

In at least one embodiment, an advantage realized by such a system is that an FI-FCM having a unibody structure allows flow control components like a choke, sensors, and flowmeters to be packaged inside the unibody structure instead being distinctly connected to a flow-only component, such as a choke and requiring a multitude of spools and mechanical fixings. A further advantage is compactness of an FI-FCM to reduce on footprints, capital expenditure, and maintenance for a system incorporating an FI-FCM having a unibody structure.

In at least one embodiment, FIG. 1 illustrates an example environment 100 that is associated with improvements described herein. A drilling operation in an example environment 100 may include a vessel or offshore structure 102 that is adapted to float on a sea surface 104 so that it is substantially above a wellbore 106. In at least one embodiment, such a system described herein may be adapted in an onshore wellbore as well.

A wellhead 108 may be provided at a top of the wellbore 106. The wellhead 108 may be connected to a blowout preventer (BOP) 110. In at least one embodiment, the BOP 110 may be arranged above a Christmas tree (XT) 102, which may be production tree. In at least one embodiment, the XT 112 may include valves, spools, fittings, instrumentation, and the like. Further, the BOP 110 may be connected to a vessel 102 by a drilling riser 114.

In at least one embodiment, during drilling operations, a drill string 116 passes from a rig 118 on a vessel 102, through a drilling riser 114, through a BOP 110, through a wellhead 108, and into the wellbore 106. A lower end of the drill string 116 may include an attached drill bit 120 that may extend into the wellbore 106 as the drill string 116 turns. Further features of a drilling operation include a mud pump 122 that may be coupled or connected to the BOP 110, while a separate mud return line 126 is coupled or connected between the mud pump 122 and the vessel 102. Mud from the mudline 132 may be pumped to a BOP and the mud return line 126 enables a separate a return path for such mud.

A remotely operated vehicle (ROV) 128 may be used to adjust, repair, or replace equipment as necessary in the drilling operations and in subsequent production operations. Although a BOP 110 is illustrated roughly, an XT 112 may be additionally attached to other well equipment, including, for example, a spool, a manifold, or another valve or completion assembly. In at least one embodiment, drilling the wellbore 106 may be started by use of a suction pile 130. The wellhead 108 may be associated with a top of a suction pile 130 and the suction pile 130 may be lowered to a sea floor at a mudline 132.

In at least one embodiment, as interior chambers in a suction pile 130 are evacuated, such a suction pile 130 may be driven into the mudline 132 till the suction pile 130 is substantially submerged in the sea floor, through the mudline 132. The wellhead 108 may be positioned at the mudline 132 as a result and then drilling operations may commence. As the wellbore 106 is drilled, walls of a wellbore 106 may be reinforced with casings and concrete 134 to provide stability to the wellbore 106 and to help control pressure from within a formation 136.

Figure 2:
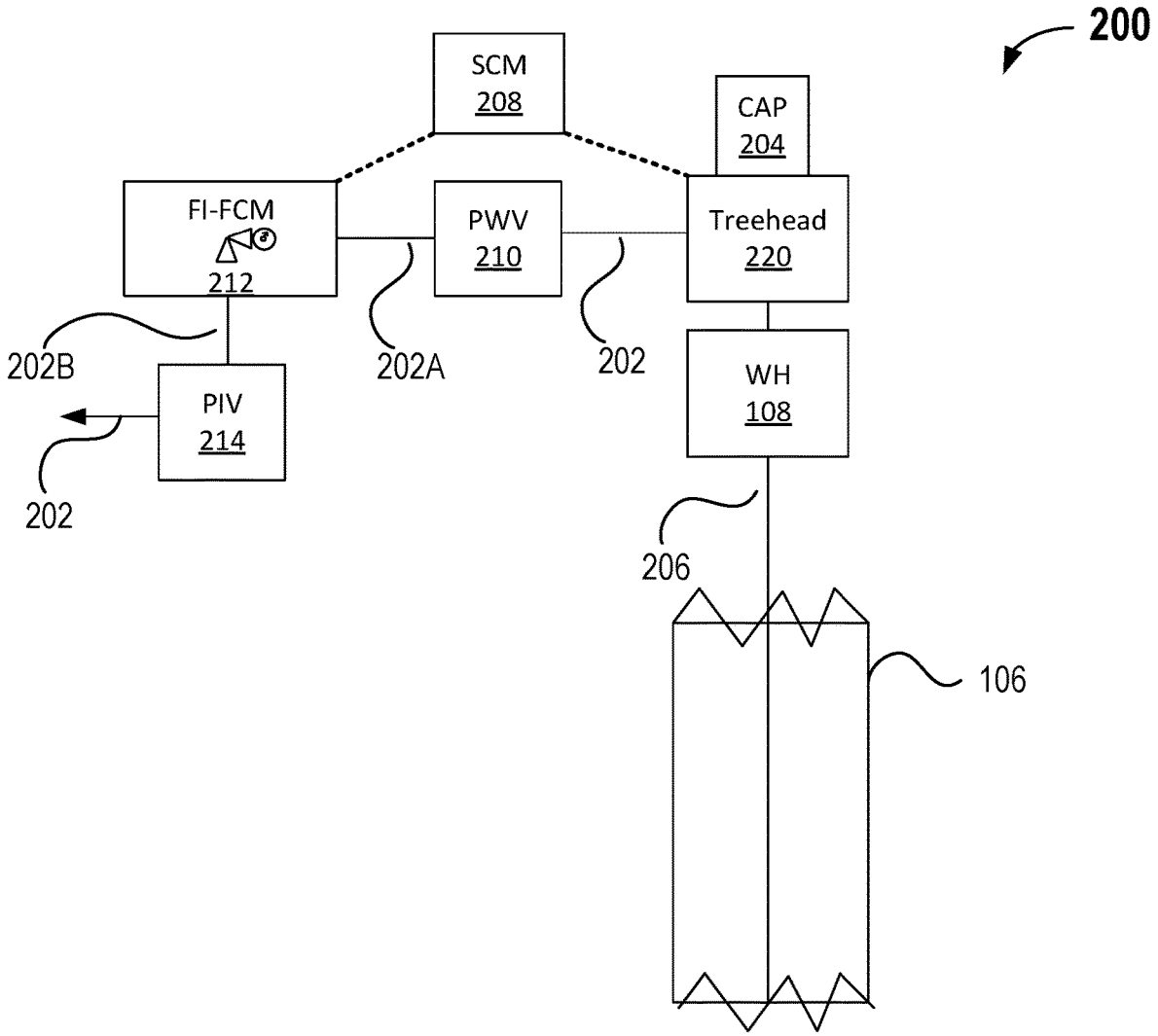
FIG. 2 illustrates a line diagram detailing features of a fully-integrated flow control module (FI-FCM) based in part on its interactions within the example environment, in at least one embodiment.

FIG. 2 illustrates a line diagram 200 detailing features of a flow control module (FCM) 212 based in part on its interactions within the example environment, in at least one embodiment. In at least one embodiment, during production or other operations, a production riser 206 may be associated with a wellhead 108 and treehead 220 of an XT 112. In at least one embodiment, an XT 112 may include a variety of pressure and/or temperature transducers.

In at least one embodiment, instrumentation may be arranged between one or more valves 210, 214. In at least one embodiment, an FI-FCM 212 may be positioned between a production wing valve 210 and a production isolation valve 214. As such, pressure in a flow line 202, when the valves 210, 214 are closed may be monitored by a flow measures or other instruments of an FI-FCM 212 to check for leaks throughout a flow line 214.

In at least one embodiment, by closing a production wing valve (PWV) 210, leaks in a wellbore 106, up to a connection at a flow line 202 may be evaluated via the instrumentation of the unibody structure FCM 212. Furthermore, a treehead 220 and a FI-FCM 212 may be controlled via a subsea control module (SCM) 208. In at least one embodiment, the SCM 208 may be operated via an ROV. In at least one embodiment, the SCM 208 may be utilized to control operation of one or more valves on the treehead 220 and to read and control an FI-FCM 212. The SCM 208 may receive inputs from one or more of the instrumentations, such as a flow meter of an FI-FCM 212. The SCM 208 may be used to react by transmitting a signal to one or more valves to close or throttle, which can block a production flow of reservoir fluid through the wellbore 106.

In at least one embodiment, further, valves may be provided for a cross over function that may be arranged between the PWV 210 and a production injection valve (PIV) 214. The cross over function enables a connection between an annulus portion of the wellbore 106 and a production portion of a wellbore 106. In at least one embodiment, this connection may be utilized to allow communication between the production and annulus bores. Additionally, a production portion of a wellbore 106 may be associated with a chemical injection valve that is arranged between the PWV 210 and the PIV 214.

In at least one embodiment, a chemical injection valve may be arranged at a different location on the production portion of the wellbore 106. In at least one embodiment, an FI-FCM 212 may be arranged between the PWV 210 and the PIV 214. The FI-FCM 212 may include a valve, orifice plate, or choke to regulate flow to the PIV 214 between an entry and an exit flow path within the FI-FCM 212. The FI-FCM 212 is also illustrated as located between an upstream flow line 202A and a downstream flowline 202B of a flow line 202. Further, the valve, orifice plate, or choke of the FI-FCM 212 is to regulate flow and may be manual or actuated valves (e.g., hydraulic, electric, pneumatic, and the like).

In at least one embodiment, therefore, such features within an FI-FCM 212 may be coupled to controllers and/or actuators to drive movement between an open, a closed position, or some position between for a gate or other valve 214. Furthermore, in at least one environment, manual valves may be operated by an ROV. Valves for an FI-FCM 212, as described herein, may include gate valves, globe valves, ball vales, butterfly valves, diaphragm valves, clapper valves, knife valves, needle valves, plug valves, or any other type of valve that may reasonable be utilized for production of reservoir fluid. Components of the valves, such as the trim, packing, and the like may be particularly selected for the application in which the valve is used. In at least one embodiment, therefore, valves in sour environments (e.g., hydrogen sulfide environments) may include components specified by the NACE International®.

Figure 3A:
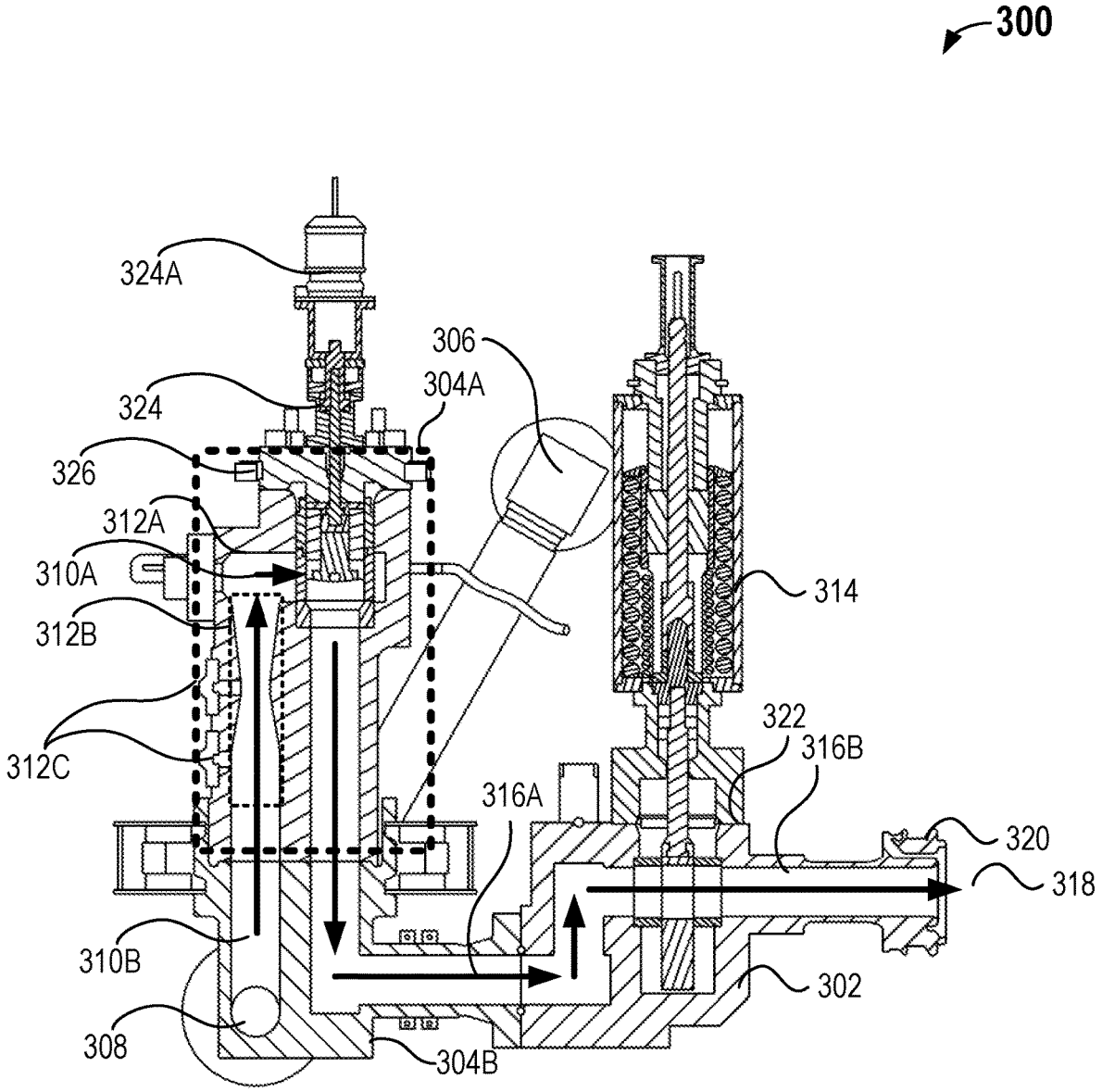
FIG. 3A illustrates a sectional view of a fully-integrated flow control module (FI-FCM) having a unibody structure, in at least one embodiment.

FIG. 3A illustrates a sectional view 300 of a fully-integrated flow control module (FI-FCM) 304A having a unibody structure, in at least one embodiment. FIG. 3A therefore illustrates, in part, the FI-FCM 212 of FIG. 2. The FI-FCM 304A includes an entry flow path 310A, 310B that may be associated with an entry point 308 that is coupled to a flow line 306 of a system for production of reservoir fluid. In at least one embodiment, such an entry flow path 310A, 310B is upstream of a flow line that proceeds through an FI-FCM and exits an FI-FCM.

In at least one embodiment, the entry flow path 310A; 310B may be defined with respect to flow of a reservoir fluid into a flow meter 312A; 312B. In at least one embodiment, the entry flow path 310A is horizontal, with respect to an axis of a wellbore, for a flow meter 312A; 312B that is located offset with respect to an entry point 308. In at least one embodiment, the entry flow path 310B is bottom-up, with respect to an axis of a wellbore, for a flow meter 312A; 312B that is located in-line with an entry point 308. In at least one embodiment, a variation in flow path may affect a measure of flow and based in part on an application determined for an FI-FCM, a selection may be made to a location of a flow meter 312A; 312B that is either offset from an entry point to allow for horizontal flow into a flow meter or in-line from an entry point to allow for bottom-up flow into a flow meter.

The FI-FCM includes a unibody structure 304A which may be coupled to further structures 304B, 302. Therefore, reference numeral 304A is used to interchangeably refer to an FI-FCM and its unibody structure. In at least one embodiment, the unibody structure may be defined by a single machined piece 304A or multiple machined pieces welded together or fixedly associated together so that they are not associated together during installation of a production system for a wellhead, which would otherwise result in potential leak paths. In at least one embodiment, when multiple machine pieces are welded together or fixedly associated, they may include joints and which structure is distinct from the single machined piece. In at least one embodiment, a choke 324 having a choke actuator 324A may be associated with an FI-FCM 304A by being provided within a provision of the single machined piece 304A. In at least one embodiment, the entry flow path 310A, 310B is for reservoir fluid to flow from an entry point 308 into the FI-FCM 304A.

In at least one embodiment, an entry flow path 310A, 310B is in fluid communication with an exit flow path 316A for the reservoir fluid 318 to exit the FI-FCM 304A prior to flowing through one of provided multiple machined pieces 302, 304B and to an exit point 320. In at least one embodiment, a flow meter 312A; 312B is integrated to the unibody structure 304A and supported by pressure sensors 312C. In at least one embodiment, the flow meter 312A; 312B is in fluid communication with the entry flow path 310A, 310B. For example, the entry flow path 310A, 310B allows reservoir fluid to flow through the flow meter 312A; 312B, such as entering on one side of the flow meter and exiting on another side of the flow meter 312A; 312B. However, an entry flow path 310A, 310B may allow reservoir fluid to flow past a flow meter 312A; 312B.

In at least one embodiment, in any implementation, a flow meter 312A; 312B is located upstream relative to the choke 324. Further, the choke is to control flow of the reservoir fluid between the entry flow path 310A, 310B and the exit flow path 316A prior to reaching a gate valve 314 that is within a provision 322 within one machined piece 302 of the multiple machined pieces. The machined piece including the gate valve 314 may be associated with the machine piece forming the FI-FCM 304A by a coupling feature, such as a flange. In at least one embodiment, reservoir fluid 318 exits the one machined piece 302 of the multiple machined pieces at an exit point 320. In at least one embodiment, an indicating or transmitting component of the flow meter 312A; 312B enables flow information, such as pressures, to be transmitted remotely from the FI-FCM 304A.

In at least one embodiment, further, a retrievability feature 326 may be provided for the FI-FCM 304A. This allows for the flow meter 312A; 312B and the choke 324, representing all or part of the FI-FCM, to be retrievably installed for cost effective benefits. In at least one embodiment, the FI-FCM 304A can support injection applications for well fluid or intervention fluid to be injected into a well distinctly from reservoir fluids that are retrieved from the well. In at least one embodiment, in injection applications, well fluids may be injected gas or injected water. In at least one embodiment, for an injection application, the FI-FCM 304A includes a single-phase flow meter 312A; 312B and a choke 324. In at least one embodiment, such an arrangement allows the FI-FCM 304A to control injected gas flow of a well, such as a gas injection well flow of water in a water injection well.

In at least one embodiment, the system of the FI-FCM includes, integrated therewith, one or more sensors for salinity measurements, sand detection, erosion monitoring, pressure monitoring, and temperature monitoring. Furthermore, the flow meter 312A; 312B is adapted for multiphase flow measurements or single-phase flow measurements depending on an application of the FI-FCM 304A. In at least one embodiment, the one or more sensors is adapted for gas, oil, condensate, and/or water flow measurements.

Figure 3B:
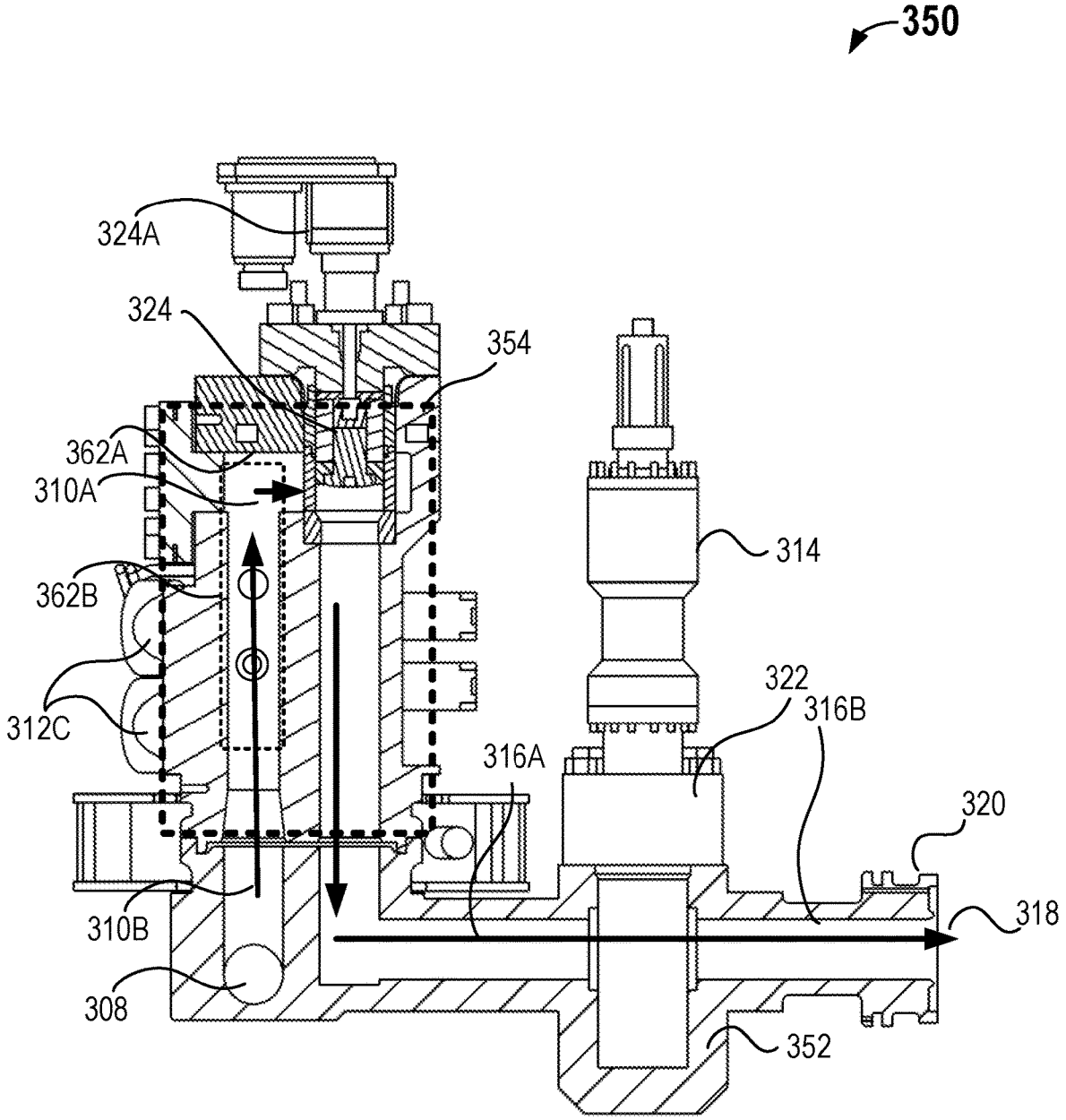
FIG. 3B illustrates a further sectional view of a fully-integrated flow control module (FI-FCM) having a unibody structure, in at least one embodiment.

FIG. 3B illustrates a sectional view 350 of a fully-integrated flow control module (FI-FCM) 354 having a unibody structure, in at least one embodiment. FIG. 3B therefore illustrates, in part, the FI-FCM 212 of FIG. 2 and may be a variation of the FI-FCM 304A of FIG. 3A. The FI-FCM 354 includes an entry flow path 310A, 310B that may be associated with an entry point 308 that is coupled to a flow line of a system for production of reservoir fluid. In at least one embodiment, such an entry flow path 310A, 310B is upstream of a flow line that proceeds through an FI-FCM and exits an FI-FCM.

In at least one embodiment, the entry flow path 310A; 310B may be defined with respect to flow of a reservoir fluid into a flow meter 362A; 362B. In at least one embodiment, the entry flow path 310A is horizontal, with respect to an axis of a wellbore, for a flow meter 362A; 362B that is located offset with respect to an entry point 308. In at least one embodiment, the entry flow path 310B is bottom-up, with respect to an axis of a wellbore, for a flow meter 362A; 362B that is located in-line with an entry point 308. In at least one embodiment, a variation in flow path may affect a measure of flow and based in part on an application determined for an FI-FCM, a selection may be made to a location of a flow meter 362A; 362B that is either offset from an entry point to allow for horizontal flow into a flow meter or in-line from an entry point to allow for bottom-up flow into a flow meter.

The FI-FCM includes a unibody structure 354 which may be coupled to at least one further structure 352. Differently than in FIG. 3A, the further structure 352 is another unibody structure having the entry point 308 and a gate valve 314 that is within a provision 322 as part one machined piece that is distinct from another machined piece FI-FCM 354. Therefore, reference numeral 354 is used to interchangeably refer to an FI-FCM and its unibody structure. In at least one embodiment, the unibody structure may be defined by a single machined piece 354 or multiple machined pieces welded together or fixedly associated together so that they are not associated together during installation of a production system for a wellhead, which would otherwise result in potential leak paths.

In at least one embodiment, when multiple machine pieces are welded together or fixedly associated, they may include joints and which structure is distinct from the single machined piece. In at least one embodiment, a choke 324 having a choke actuator 324A may be associated with an FI-FCM 354 by being provided within a provision of the single machined piece 354. In at least one embodiment, the entry flow path 310A, 310B is for reservoir fluid to flow from an entry point 308 into the FI-FCM 354.

In at least one embodiment, an entry flow path 310A, 310B is in fluid communication with an exit flow path 316A for the reservoir fluid 318 to exit the FI-FCM 354 prior to flowing through one of provided multiple machined pieces 352, 354 and to an exit point 320. In at least one embodiment, a flow meter 362A; 362B is integrated to the unibody structure 304A and supported by pressure sensors 312C. In at least one embodiment, the flow meter 362A; 362B is in fluid communication with the entry flow path 310A, 310B. For example, the entry flow path 310A, 310B allows reservoir fluid to flow through the flow meter 362A; 362B, such as entering on one side of the flow meter and exiting on another side of the flow meter 362A; 362B. However, an entry flow path 310A, 310B may allow reservoir fluid to flow past a flow meter 362A; 362B.

In at least one embodiment, in any implementation, a flow meter 362A; 362B is located upstream relative to the choke 324. Further, the choke is to control flow of the reservoir fluid between the entry flow path 310A, 310B and the exit flow path 316A prior to reaching a gate valve 314 that is within a provision 322 within the one machined piece 302 that is distinct from the machined piece forming the FI-FCM 354. In at least one embodiment, reservoir fluid 318 exits the one machined piece 352 of the multiple machined pieces at an exit point 320. In at least one embodiment, an indicating or transmitting component of the flow meter 362A; 362B enables flow information, such as pressures, to be transmitted remotely from the FI-FCM 354.

In at least one embodiment, further, a retrievability feature may be provided for the FI-FCM 354. This allows for the flow meter 362A; 362B and the choke 324 to be retrievably installed for cost effective benefits. In at least one embodiment, the FI-FCM 354 can support injection applications for well fluid or intervention fluid to be injected into a well distinctly from reservoir fluids that are retrieved from the well. In injection applications, well fluids may be injected gas or injected water. For an injection application, the FI-FCM 354 includes a single-phase flow meter 362A; 362B and a choke 324. In at least one embodiment, such an arrangement allows the FI-FCM 354 to control injected gas flow of a well, such as a gas injection well flow of water in a water injection well.

In at least one embodiment, the system of the FI-FCM includes, integrated therewith, one or more sensors for salinity measurements, sand detection, erosion monitoring, pressure monitoring, and temperature monitoring. Furthermore, the flow meter 362A; 362B is adapted for multiphase flow measurements or single-phase flow measurements depending on an application of the FI-FCM 354. In at least one embodiment, the one or more sensors is adapted for gas, oil, condensate, and/or water flow measurements.

Figure 4A:
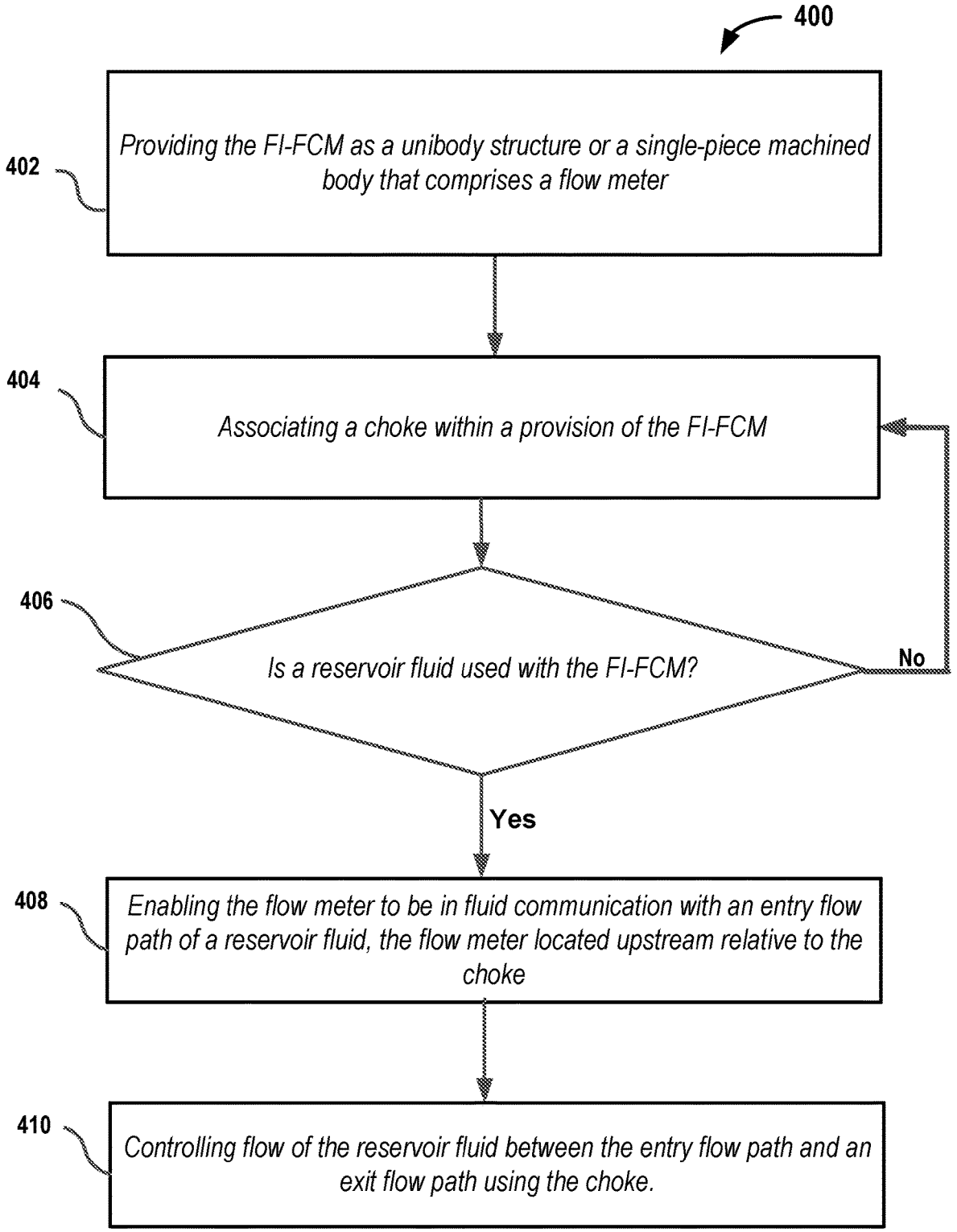
FIG. 4A illustrates a method for a fully-integrated flow control module (FI-FCM) in a hydrocarbon reservoir, according to at least one embodiment.

FIG. 4A illustrates a method 400 for a fully-integrated flow control module (FI-FCM) in a hydrocarbon reservoir, according to at least one embodiment. In at least one embodiment, the method 400 includes providing (402) an FI-FCM as a unibody structure or a single-piece machined body that has a flow meter integrated therein. In at least one embodiment, the method 400 includes associating a choke within a provision of the FI-FCM. In at least one embodiment, the choke may be bolted to the unibody structure in this step.

In at least one embodiment, the method 400 includes verifying via a step (406) that the FI-FCM is to be used with a reservoir fluid. In at least one embodiment, different settings or control adjustments via the flow meter and the choke may be enabled for different applications prior to installing within the system having the FI-FCM into a production system for reservoir fluid. In at least one embodiment, a positive outcome of such a verification results in an enabling (408) feature for the flow meter to be in fluid communication with an entry flow path of a reservoir fluid. In at least one embodiment, adjustments may include determining that the flow meter is to be located upstream relative to the choke. In the enabling feature, the installation of the FI-FCM in an application is such that the flow meter is located upstream relative to the choke. In at least one embodiment, step 404 may otherwise be repeated to ensure proper installation. The method 400 herein includes controlling (410) a flow of the reservoir fluid between the entry flow path and an exit flow path using the choke.

Figure 4B:
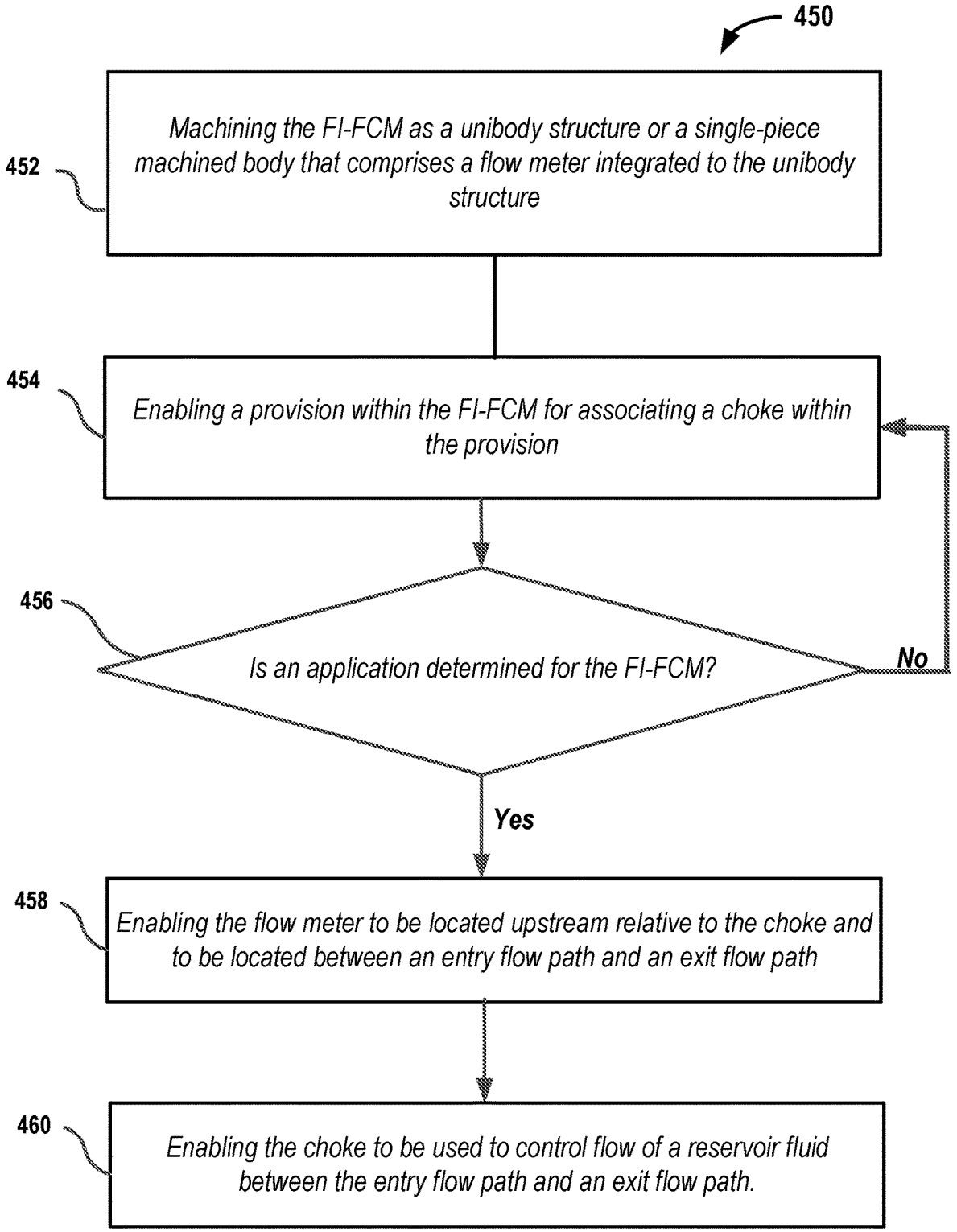
FIG. 4B illustrates another method for a fully-integrated flow control module (FI-FCM) in a hydrocarbon reservoir, according to at least one embodiment.

FIG. 4B illustrates another method 450 for a fully-integrated flow control module (FI-FCM) in a hydrocarbon reservoir, according to at least one embodiment. The method 450 includes machining (452) the FI-FCM as a unibody structure or a single-piece machined body that comprises a flow meter integrated therein. A further step (454) is for enabling a provision within the FI-FCM for associating a choke within the provision. In at least one embodiment, verification (456) may be performed for an application intended for the FI-FCM. In at least one embodiment, different settings or control adjustments via the flow meter and the choke may be enabled for different applications prior to installing within a production system for reservoir fluid.

In at least one embodiment, the method 450 includes enabling (458) the flow meter to be located upstream relative to the choke and located between an entry flow path and an exit flow path. A further step is for enabling (460) the choke to be used to control flow of a reservoir fluid between the entry flow path and an exit flow path. In at least one embodiment, a method 450 herein may be associated with manufacturing or provisioning an FI-FCM for applications with reservoir fluids from hydrocarbon environments. In at least one embodiment, a method 400 herein may be associated with operations of an FI-FCM for applications having reservoir fluids in hydrocarbon environments.

In at least one embodiment, the machining (452) may include machining the FI-FCM to further include, integrated therewith, one or more sensors for salinity measurements, sand detection, erosion monitoring, pressure monitoring, and temperature monitoring. Further, the machining (452) may include machining the FI-FCM to further include, integrated therewith, a feature for injection applications of well fluid or intervention fluid to be injected into a well associated with the hydrocarbon reservoir. Still further, the machining (452) may include machining the FI-FCM to further include adaptation for multiphase flow measurements or single-phase flow measurements based in part on an application of the FI-FCM.

In at least one embodiment, the machining (452) may include machining the FI-FCM to further include a retrievability feature to allow retrievable installation for all or part of the FI-FCM. Then, the method 450 may include providing a coupling feature of the FI-FCM to associate a gate valve that is within a second single-piece machined body with the FI-FCM. This allows association of a machined body having the gate valve with the FI-FCM.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

Operations of methods in the Figures described herein can be performed in any suitable order unless otherwise indicated herein or otherwise clearly contradicted by context. In at least one embodiment, a method includes processes such as those processes described herein (or variations and/or combinations thereof) that may be performed under control of one or more computer systems configured with executable instructions and that may be implemented as code (e.g., executable instructions, one or more computer programs or one or more applications) executing collectively or exclusively on one or more processors, by hardware or combinations thereof.

In at least one embodiment, such code may be stored on a computer-readable storage medium. In at least one embodiment, such code may be a computer program having instructions executable by one or more processors. In at least one embodiment, a computer-readable storage medium is a non-transitory computer-readable storage medium that excludes transitory signals (such as a propagating transient electric or electromagnetic transmission) but includes non-transitory data storage circuitry (such as buffers, cache, and queues) within transceivers of transitory signals. In at least one embodiment, code (such as executable code or source code) is stored on a set of one or more non-transitory computer-readable storage media having stored thereon executable instructions (or other memory to store executable instructions) that, when executed (such as a result of being executed) by one or more processors of a computer system, cause computer system to perform operations described herein.

In at least one embodiment, a set of non-transitory computer-readable storage media includes multiple non-transitory computer-readable storage media and one or more of individual non-transitory storage media of multiple non-transitory computer-readable storage media lack all of code while multiple non-transitory computer-readable storage media collectively store all of code. In at least one embodiment, executable instructions are executed such that different instructions are executed by different processors—in at least one embodiment, a non-transitory computer-readable storage medium store instructions and a main central processing unit (CPU) executes some of instructions while other processing units execute other instructions. In at least one embodiment, different components of a computer system have separate processors and different processors execute different subsets of instructions.

In at least one embodiment, computer systems are configured to implement one or more services that singly or collectively perform operations of processes described herein and such computer systems are configured with applicable hardware and/or software that enable performance of operations. In at least one embodiment, a computer system that implements at least one embodiment of present disclosure is a single device or is a distributed computer system having multiple devices that operate differently such that distributed computer system performs operations described herein and such that a single device does not perform all operations.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

What is claimed is:

1. A system for a fully-integrated flow control module (FI-FCM) in a hydrocarbon reservoir, the system comprising:

a single-piece machined body forming the FI-FCM;

a choke to be associated within a provision that is inside the FI-FCM, wherein the provision for the choke is to enable the choke to access the FI-FCM in only one direction that is vertical with respect to an axis of a wellbore of the hydrocarbon reservoir;

an entry flow path for reservoir fluid inside the FI-FCM;

an exit flow path for the reservoir fluid inside the FI-FCM, the exit flow path comprising a section which is horizontal with respect to the axis of the wellbore and to couple to a valve that is external to the FI-FCM; and a flow meter integrated to the single-piece machined body and to be in fluid communication with the entry flow path, the flow meter to be upstream relative to the choke, wherein the choke is to control flow between the entry flow path and the exit flow path.

2. The system of claim 1, wherein the FI-FCM further comprises, integrated therewith, one or more sensors for one or more of salinity measurements, sand detection, erosion monitoring, pressure monitoring, or temperature monitoring.

3. The system of claim 1, wherein the FI-FCM further comprises, integrated therewith, a feature for injection applications of well fluid or intervention fluid to be injected into a well associated with the hydrocarbon reservoir.

4. The system of claim 1, wherein the FI-FCM is further adapted for multiphase flow measurements or single-phase flow measurements based in part on an application of the FI-FCM.

5. The system of claim 1, wherein the FI-FCM further comprises a retrievability feature to allow retrievable installation for all or part of the FI-FCM.

6. The system of claim 1, further comprising:

a gate valve that is a second single-piece machined body to be associated with the FI-FCM, wherein the FI-FCM comprises at least one feature to drive movement between an open position, a closed position, or some position there between for the gate valve.

7. The system of claim 1, further comprising:

an indicating or transmitting component of the flow meter to transmit flow information remotely from the FI-FCM.

8. The system of claim 1, further comprising:

enabling an indicating or transmitting component of the flow meter transmit flow information remotely from the FI-FCM.

9. A method for a fully-integrated flow control module (FI-FCM) in a hydrocarbon reservoir, the method comprising:

providing the FI-FCM as a single-piece machined body that comprises a flow meter integrated to the single-piece machined body;

associating a choke within a provision that is inside the FI-FCM, wherein the provision for the choke is to enable the choke to access the FI-FCM in only one direction that is vertical with respect to an axis of a wellbore of the hydrocarbon reservoir;

enabling the flow meter to be in fluid communication with an entry flow path of a reservoir fluid, the flow meter located upstream relative to the choke; and controlling flow of the reservoir fluid between the entry flow path and an exit flow path using the choke, the exit flow path comprising a section which is horizontal with respect to the axis of the wellbore and to couple to a valve that is external to the FI-FCM.

10. The method of claim 9, wherein the FI-FCM further comprises, integrated therewith, one or more sensors for one or more of salinity measurements, sand detection, erosion monitoring, pressure monitoring, or temperature monitoring.

11. The method of claim 9, wherein the FI-FCM further comprises, integrated therewith, a feature for injection applications of well fluid or intervention fluid to be injected into a well associated with the hydrocarbon reservoir.

12. The method of claim 9, wherein the FI-FCM is further adapted for multiphase flow measurements or single-phase flow measurements based in part on an application of the FI-FCM.

13. The method of claim 9, wherein the FI-FCM further comprises a retrievability feature to allow retrievable installation for all or part of the FI-FCM.

14. The method of claim 9, further comprising:

associating a gate valve that is within a second single-piece machined body with the FI-FCM; and driving movement of the gate valve between an open position, a closed position, or some position there between for the gate valve using at least one feature of the FI-FCM.

15. A method for a fully-integrated flow control module (FI-FCM) in a hydrocarbon reservoir, the method comprising:

machining the FI-FCM as a single-piece machined body and that comprises a flow meter integrated in the single-piece machined body;

enabling a provision that is inside the FI-FCM for associating a choke within the provision, wherein the provision for the choke is to enable the choke to access the FI-FCM in only one direction that is vertical with respect to an axis of a wellbore of the hydrocarbon reservoir;

enabling the flow meter to be located upstream relative to the choke between an entry flow path and an exit flow path; and enabling the choke to be used to control flow of a reservoir fluid between the entry flow path and an exit flow path, the exit flow path comprising a section which is horizontal with respect to the axis of the wellbore and to couple to a valve that is external to the FI-FCM.

16. The method of claim 15, further comprising:

machining the FI-FCM to further comprise, integrated therewith, one or more sensors for one or more of salinity measurements, sand detection, erosion monitoring, pressure monitoring, or temperature monitoring.

17. The method of claim 15, further comprising:

machining the FI-FCM to further comprise, integrated therewith, a feature for injection applications of well fluid or intervention fluid to be injected into a well associated with the hydrocarbon reservoir.

18. The method of claim 15, wherein the FI-FCM is further adapted for multiphase flow measurements or single-phase flow measurements based in part on an application of the FI-FCM.

19. The method of claim 15, further comprising:

machining the FI-FCM to further comprise a retrievability feature to allow retrievable installation for all or part of the FI-FCM.

20. The method of claim 15, further comprising:

providing a coupling feature of the FI-FCM to associate a gate valve that is within a second single-piece machined body with the FI-FCM; and enabling driving movement of the gate valve between an open position, a closed position, or some position there between using at least one feature of the FI-FCM.

* * * * *